US008505843B2

(12) United States Patent
Veneroso et al.

(10) Patent No.: US 8,505,843 B2
(45) Date of Patent: Aug. 13, 2013

(54) CRUSHING MILL

(75) Inventors: Enrico Veneroso, Udine (IT); Guido Andreussi, Tavagnacco (IT); Eddy Pontelli, Tricesimo (IT); Olivia Andreussi, Artegna (IT)

(73) Assignee: RAF—Ricambi Attrezzature per la Frantumazione-SpA, Montesilvano (PE) (IT)

( * ) Notice: Subject to any disclaimer, the term of this patent is extended or adjusted under 35 U.S.C. 154(b) by 361 days.

(21) Appl. No.: 12/946,988

(22) Filed: Nov. 16, 2010

(65) Prior Publication Data

US 2011/0114776 A1 May 19, 2011

(30) Foreign Application Priority Data

Nov. 19, 2009 (IT) ..... UD2009A0211

(51) Int. Cl.
*B02C 13/26* (2006.01)

(52) U.S. Cl.
USPC ..... 241/285.3

(58) Field of Classification Search
USPC ..... 241/285.1, 285.3
See application file for complete search history.

(56) References Cited

U.S. PATENT DOCUMENTS

| | | | | |
|---|---|---|---|---|
| 3,899,965 | A * | 8/1975 | Koch et al. | 100/155 R |
| 4,073,444 | A * | 2/1978 | Pav | 241/73 |
| 4,718,614 | A * | 1/1988 | Hausler et al. | 241/189.1 |
| 5,513,811 | A * | 5/1996 | Phan Hung | 241/189.1 |
| 5,746,377 | A * | 5/1998 | Gehrig | 241/73 |
| 5,775,609 | A * | 7/1998 | Ackers et al. | 241/285.3 |
| 6,070,819 | A * | 6/2000 | Young et al. | 241/189.1 |
| 6,581,862 | B1 * | 6/2003 | Young et al. | 241/189.1 |
| 7,021,576 | B2 * | 4/2006 | Poeltinger | 241/73 |
| 7,229,041 | B2 * | 6/2007 | Cohen et al. | 241/285.3 |
| 7,360,727 | B2 * | 4/2008 | Schantz et al. | 241/30 |
| 7,451,945 | B2 * | 11/2008 | Wollenhaupt et al. | 241/232 |
| 8,033,487 | B2 * | 10/2011 | Yamashita et al. | 241/73 |
| 2009/0294563 | A1 * | 12/2009 | Yamashita et al. | 241/221 |

FOREIGN PATENT DOCUMENTS

| | | | |
|---|---|---|---|
| EP | 0 370 861 | A1 | 5/1990 |
| GB | 2 230 475 | A | 10/1990 |
| WO | 02/22269 | A1 | 3/2002 |

OTHER PUBLICATIONS

Italian Search Report issued on Jul. 7, 2010 in Italian Application No. UD2009A000211.

* cited by examiner

*Primary Examiner* — Faye Francis
(74) *Attorney, Agent, or Firm* — Panitch Schwarze Belisario & Nadel LLP

(57) ABSTRACT

A crushing mill for inert material includes a distribution unit, a crushing unit disposed below the distribution unit and a containment structure to contain the distribution unit and the crushing unit. The distribution unit receives the inert material from a feed device and suitably directs it toward the crushing unit below, for the secondary and/or tertiary crushing of the inert material. The containment structure has at least two lower lateral semi-shells, associated with the crushing unit, and at least two upper lateral semi-shells, associated with the distribution unit, which are selectively movable, independently or together, so as to obtain an at least partly open configuration of the mill, which leaves at least the distribution unit completely uncovered and easily accessible, and advantageously also the crushing unit.

10 Claims, 7 Drawing Sheets

CRUSHING MILL

FIELD OF THE INVENTION

The present invention concerns a crushing mill. In particular, the present invention concerns a mill for the secondary and/or tertiary type crushing of inert material.

BACKGROUND OF THE INVENTION

Crushing mills are known for the secondary and/or tertiary type crushing of inert material, that is, able to obtain the desired granulometry of the material to be crushed.

Known crushing mills normally comprise a distribution unit, consisting of a rotor on the periphery of which a plurality of blades are fixed.

This distribution unit has the function of receiving the material entering from a suitable feed unit and to suitably direct it to a crushing unit, which is normally disposed below the distribution unit.

The distribution unit is housed inside a distribution chamber, which has an upper aperture in order to receive the material to be crushed and a lower aperture in order to unload it toward the bottom, where the crushing unit is.

In its turn the crushing unit comprises a crushing rotor, on the periphery of which a plurality of hammers are fixed, or functionally similar elements, to crush the material.

The crushing rotor is positioned inside a crushing chamber, which is peripherally delimited by wall elements suitably shaped and having a protruding profile with ridges facing toward the inside of the crushing chamber or toward the rotor.

The shaped elements are normally disposed adjacent to each other, forming a wall or shield around the crushing rotor and shaped toward the inside of the crushing chamber. The elements are supported and maintained in position by one or more shield-carrying elements disposed outside the crushing chamber and on which they are mounted.

The hammers of the crushing rotor, as they turn, throw the material coming from the distribution unit toward the shield.

The ridged profiles of the shield cause the material to be crushed following the impact with the material thrown toward it.

The distribution chamber and the crushing chamber are normally housed inside a box-like structure, which can be at least partly opened in order to define a first completely closed position, in which all the elements that make up the box-like structure are close to each other and define a closed internal volume, and a second partly open position, in which at least some of the elements are in a position distanced from each other, defining at least an access aperture toward the inside of the box-like structure.

When the crushing mill is working, the box-like structure is in the completely closed position, so that the crushing of the material can occur in safe conditions inside the crushing chamber.

In order to carry out any necessary maintenance operations, the box-like structure is brought into the at least partly open position in order to allow the entrance of at least one operator inside the mill in order to carry out the repairs, substitution of worn parts etc.

In the state of the art a solution is known in which the box-like structure comprises a lower box-like element and two lateral movable casings, identical and opposite each other, mounted above the structure.

Between the two lateral casings two fixed walls are interposed, assembled on the lower box-like element and parallel to each other.

Each of the lateral casings is hinged along one of its sides to the lower box-like element by means of a hinging element, so as to enable it to partly rotate with respect to the hinging element.

The shield-carrying elements are located inside the lateral casings.

The rotation of each lateral casing selectively occurs by means of a linear actuator, suitably positioned and attached by one of its ends to the lower box-like structure and by the other end to the lateral casing to be moved.

Each lateral casing is selectively rotated toward the outside of the box-like structure, one in a clockwise direction and the other in an anti-clockwise direction, so as to obtain a semi-opening of the box-like structure, or toward the inside of the box-like structure in order to obtain the closing of said box-like structure.

The semi-opening allows access to the inside of the crushing chamber so as to carry out maintenance on the distribution unit, such as for example to replace the worn out blades, the maintenance of the shield or other.

One disadvantage of known crushing mills is that the box-like structure, in a semi-open position with both the lateral casings open, does not allow a complete view of the distribution unit, in that the casings partly obscure the view of internal parts of it, and does not allow easy access to it.

Because of this it is often necessary for at least one operator to enter the machine, when maintenance operations have to be carried out to the distribution unit, such as for example to replace worn blades.

This complicates the maintenance operations of the mill. As a consequence the maintenance times are long and the down-times of the machine connected to such maintenance operations are considerable.

Moreover, the need for an operator to enter the crushing mill in order to carry out maintenance operations, for example to the distribution unit or the crushing unit, constitutes a safety problem for the operators themselves, who check, supervise and do maintenance to the plant.

Purpose of the present invention is to improve safety conditions connected to the maintenance operations of the crushing mill, making access to the inside sections of the mill easily accessible for the operators.

In this way maintenance operations themselves are made easier, reducing the maintenance time needed.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purpose, a crushing mill for inert materials comprises a distribution unit, a crushing unit disposed below the distribution unit, and a box-like structure, able to contain said distribution unit and said crushing unit.

The distribution unit receives the inert material from a feed device and suitably directs it toward the crushing unit below, for the secondary and/or tertiary crushing of the inert material.

According to a characteristic feature of the present invention, the box-like structure has at least two lower lateral semi-shells associated with the distribution unit, and two or more upper lateral semi-shells associated with the crushing unit, which are selectively movable, independently or together, so as to obtain an at least partly open configuration of the mill, which leaves at least the distribution unit, and advantageously the crushing unit as well, completely uncovered and easily accessible, so as to promote the carrying out of maintenance operations at least on the distribution unit.

According to one solution of the invention, in which the distribution unit and the crushing unit each have an axis of rotation, the movement of the upper and/or lower lateral semi-shells occurs by means of rotation around a fulcrum lying on a plane disposed below at least the axis of rotation of the distribution unit, and advantageously also below the axis of rotation of the crushing unit.

The rotation of the semi-shells toward the outside of the box-like structure causes the box-like structure to open, which is necessary for maintenance operations.

According to a variant, the movement of the upper and/or lower lateral semi-shells occurs by means of translation on a plane substantially parallel to the plane on which the crushing mill rests.

According to another variant of the present invention, the box-like structure comprises a lower box-like element and two fixed walls substantially parallel to each other, one assembled at the front and the other at the rear on the lower box-like element and interposed between said lower and upper lateral semi-shells. The lower and upper lateral semi-shells are also movable with respect to the lower box-like element so as to selectively define at least an access opening inside the box-like structure.

According to another variant, each lower lateral semi-shell comprises a movable support element curved toward the inside of the box-like structure and able to house a wall with a shaped profile able to cooperate with the crushing unit so as to effectively crush the inert material. The movable support element is hinged on the lower part of the respective lower lateral semi-shell by means of a hinging element and selectively rotatable with respect to it.

The rotation of each movable support element toward the outside of the box-like structure makes the wall with a shaped profile easy to reach for the maintenance staff.

According to another variant, the upper and/or lower lateral semi-shells are provided at the front and/or rear with a plurality of doors which can be selectively opened to facilitate access to the inner volumes of the box-like structure in order to simplify maintenance operations to be carried out on the inside.

According to another variant of the present invention, the distribution unit comprises a rotation shaft and a plurality of fins on which blade means are attached.

In one solution of the present invention, the fins and the rotation shaft are made starting from a structural shape with a rectangular section suitably subjected to mechanical working.

Each blade mean is individually assembled on pairs of fins of the rotation shaft, so as to allow each blade mean to be dis-assembled and replaced independently.

According to a further variant, when the crushing mill is not working, the rotation shaft of the distribution unit is able to be rotated around a fulcrum on a plane parallel to the ground, so as to reduce the bulk of the distribution unit when the mill is not functioning.

According to another variant of the present invention, the lower box-like element has a plurality of reinforcement connection plates distributed along its surface, to improve the stability of the box-like structure in a condition of at least partial opening.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

With reference to the attached drawings, a crushing mill 10 for the secondary and/or tertiary crushing of inert material comprises a box-like structure 40, symmetrical with respect to an axis Y which is substantially perpendicular to the ground, inside which a distribution unit 27 and, below this, a crushing unit 32 are disposed.

Figure 2:
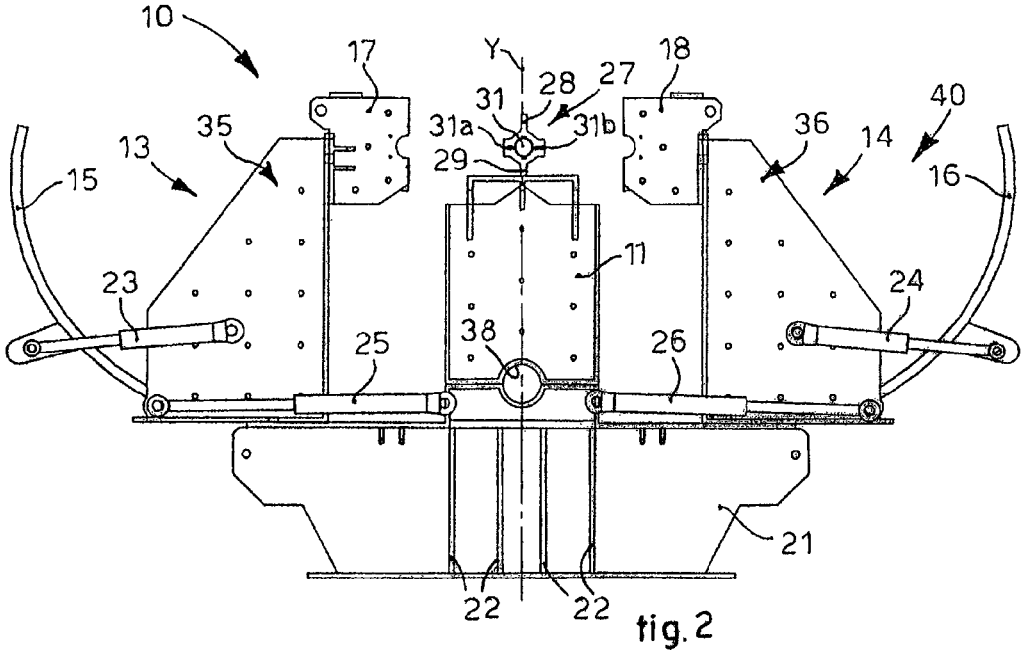
FIG. 2 is a front view of the form of embodiment of the crushing mill in FIG. 1 in a completely open position.
Figure 3:
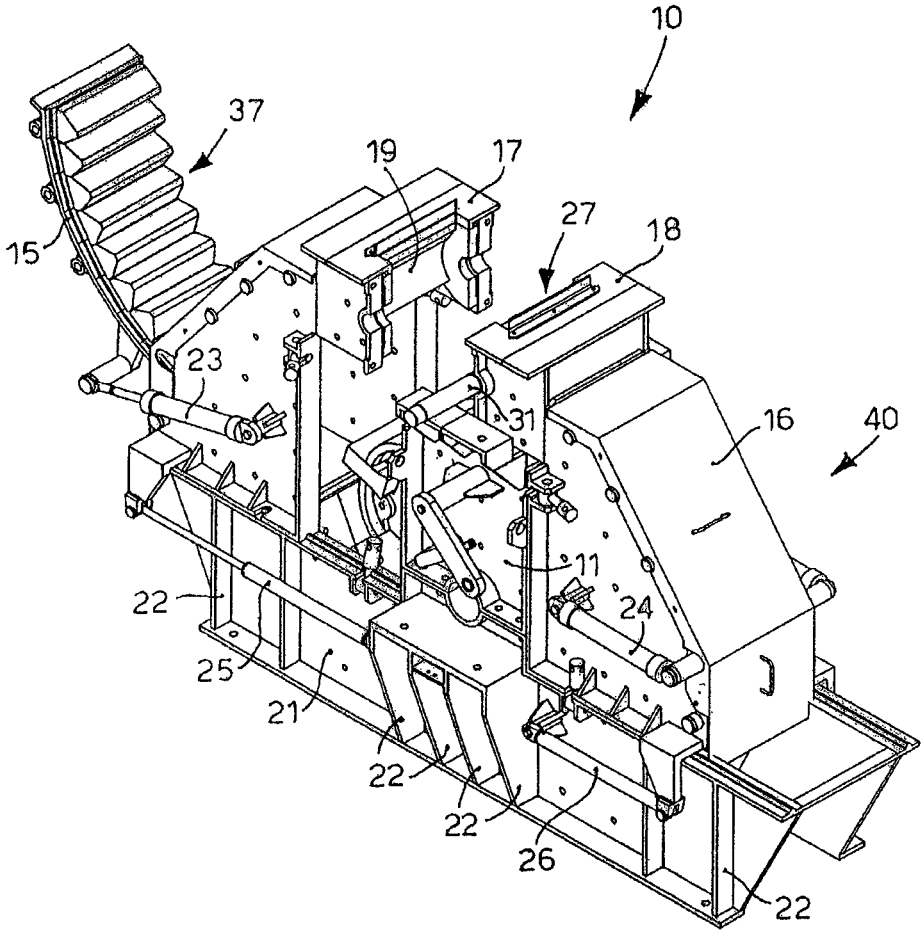
FIG. 3 is a three-dimensional view of the form of embodiment of the crushing mill in FIGS. 1 and 2 in a possible semi-open position.
Figure 4:
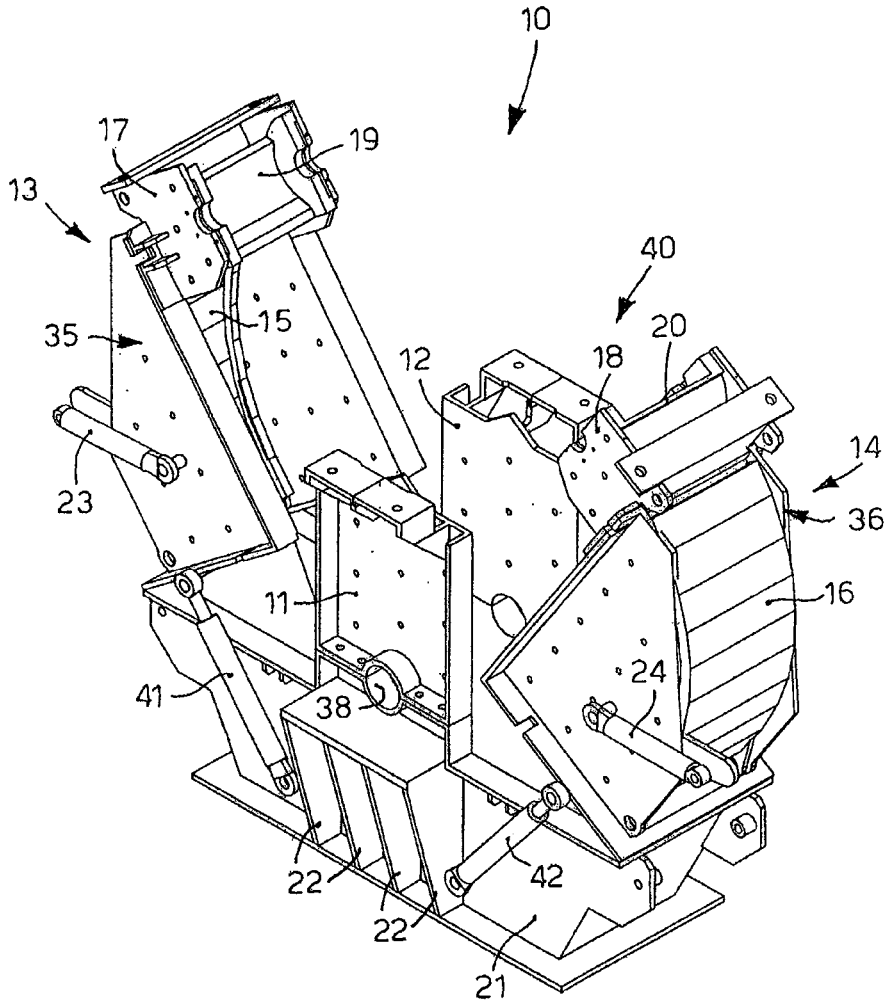
FIG. 4 is a three-dimensional view of another possible form of embodiment of the crushing mill in a possible semi-open position.
Figure 5:
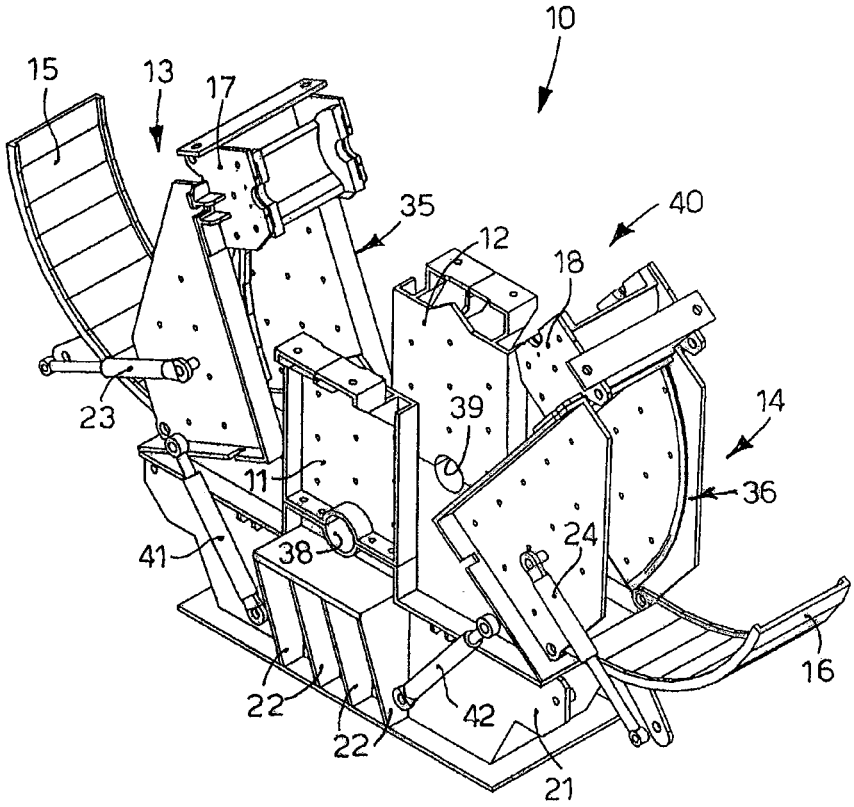
FIG. 5 is a three-dimensional view of the form of embodiment of the crushing mill in FIG. 4 in a completely open position.
Figure 6:
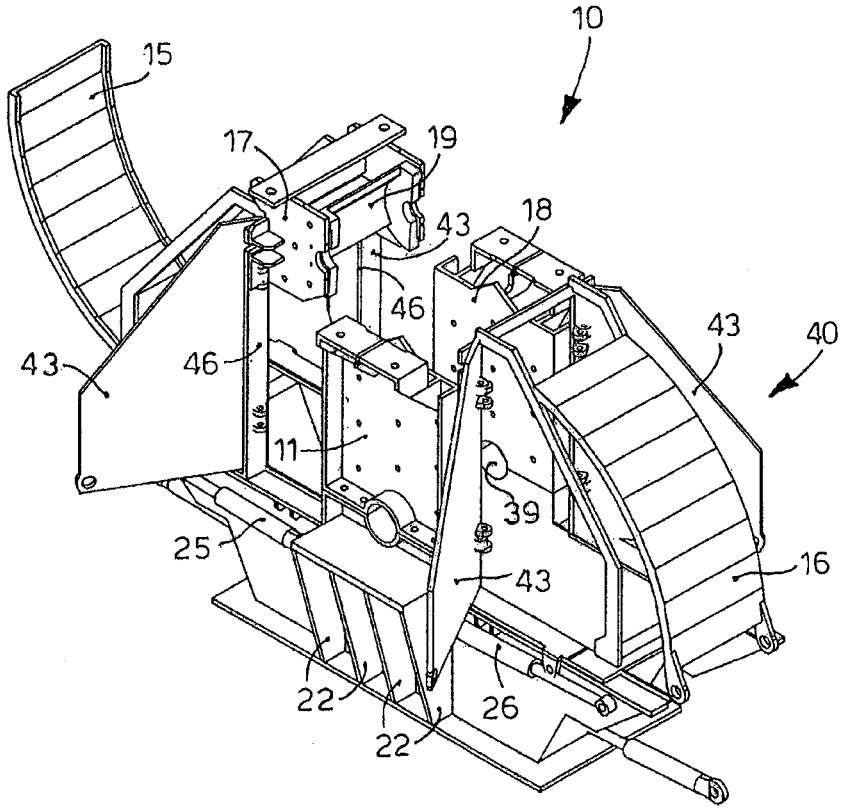
FIG. 6 is a three-dimensional view of another form of embodiment of the crushing mill in a possible semi-open position.

For the sake of simplicity, the distribution unit 27 has been omitted in FIGS. 4-6, while the crushing unit 32 has been omitted in FIGS. 2-8.

As shown in FIGS. 1, 2, 3, 7 and 8, according to a possible form of embodiment of the crushing mill 10, the distribution unit 27 comprises a rotation shaft 31 disposed substantially perpendicular to the axis Y, on which two fins 31*a* and 31*b* are made, disposed substantially at 180° with respect to each other, two blades 28 and 29 being attached to the fins 31*a* and 31*b*. It is obvious that the solution with two blades is only an example, as three or more blades can also be provided disposed on the rotation shaft 31.

The fins 31*a* and 31*b* and the rotation shaft 31 are made all in one piece starting from a section shape with a circular or polygonal section suitably subjected to mechanical working.

The blade 28 is attached both on a surface of the fin 31*a* and also on a surface of the fin 31*b*, and the blade 29 is attached on a surface of the fin 31*a* and on a surface of the fin 31*b* opposite those on which the blade 28 is attached.

The blades 28 and 29 are positioned substantially at 180° with respect to each other and at 90° with respect to each fin 31*a* and 31*b*.

Each blade 28 and 29 can be disassembled and replaced individually and it is not necessary to assemble blade carriers on the rotation shaft 31, as the blades 28 and 29 are attached directly on the shaft 31 on the fins 31*a*, 31*b*. This makes their assembly/disassembly more simple and economic.

An actuator mean (not shown) is associated with the rotation shaft 31, able to confer on it a rotational movement, and the fins 31*a* and 31*b* rotate solidly with the shaft 31. In this way, the fins 31*a* and 31*b* are able to receive the inert material coming from a device above to feed the material inside the mill 10, of any known type and not shown in the attached drawings, and to suitably direct it toward the crushing unit 32 in order to crush it.

Said actuator mean transmits motion to the rotation shaft 31 by means of a transmission element, such as a toothed distribution belt (not shown).

The rotation shaft 31 can be subjected to anomalous blockages when the fins 31*a* and 31*b* are receiving and directing the material, because the material gets blocked between the fins 31*a* and 31*b* or other. In this case, in order to avoid the risk of breakages of the transmission element, a clutch (not shown) is associated with it, which releases the transmission element from the actuator mean, if necessary.

The crushing unit 32 is disposed below the distribution unit 27 and comprises a crushing rotor 47 with relative rotation shaft 34, disposed substantially parallel to the rotation shaft 31 of the distribution unit 27 and shown in FIG. 1.

In this case, the rotation shaft 34 is made to rotate by the same actuator mean which makes the shaft 31 above rotate.

Figure 9:
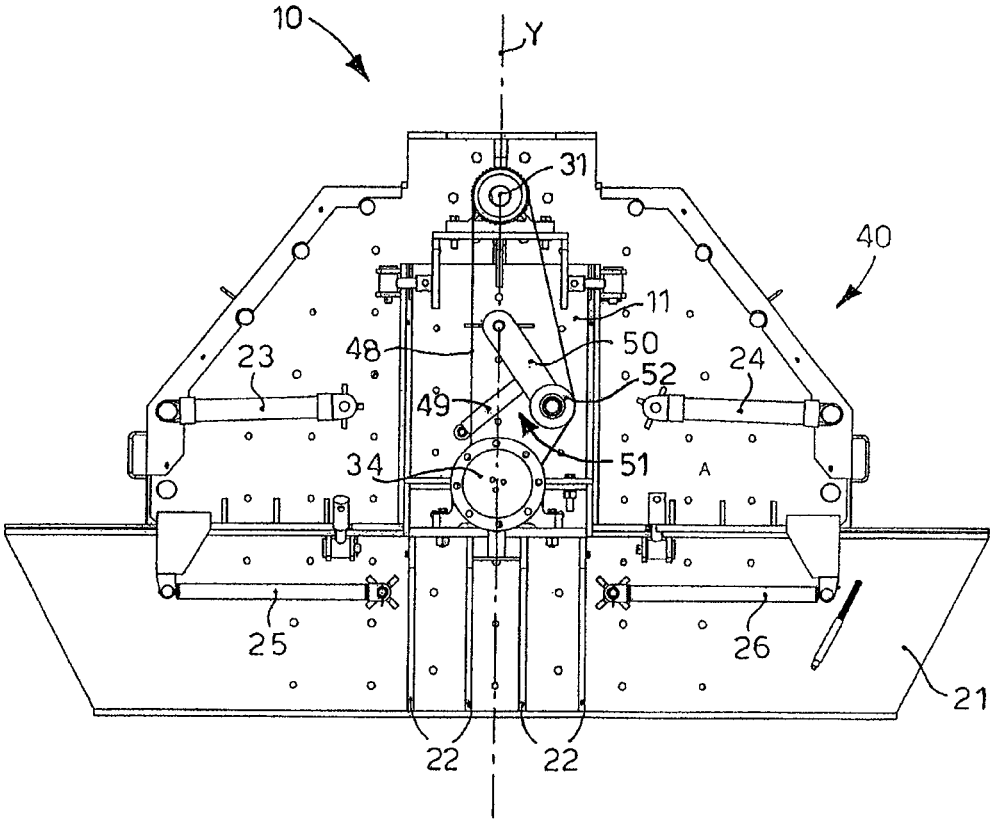
FIG. 9 is a front view of a further form of embodiment of the crushing mill.

In fact, as shown in FIG. 9, a toothed transmission belt 48 is associated with the rotation shafts 31 and 34, assembled on the fixed wall 11 and cooperating with them in order to transmit the rotational motion from the rotation shaft 31, directly driven by the actuator mean, to the rotation shaft 34.

A belt-tensing device 51 is associated with the toothed transmission belt 48 in order to keep the transmission belt 48 at the correct working tension.

The belt-tensing device 51 comprises a belt-tensing arm 50 moved by a linear actuator 49.

The linear actuator 49 comprises, in this case, a spring piston controlled by an oil pressure control unit (not shown) and moved according to an alternate rectilinear motion inside a cylinder.

The belt-tensing arm 50 has one end hinged to the fixed wall 11 and a movable end connected to the spring piston of the linear actuator 49 and made to rotate by it, at least partly, around the hinging point.

A roller 52 is assembled at the movable end, on which the transmission belt 48 slides.

In this case, when the movable end of the belt-tensing arm 50 is made to rotate in an anti-clockwise direction, the roller 52 is pushed against the transmission belt 48, tensing it even more, while, when the belt-tensing arm 50 is made to rotate in a clockwise direction, the roller 52 reduces the tension exerted on the transmission belt 48.

The belt-tensing device 51 allows to keep the tension to which the transmission belt 48 is subjected at levels required for correct functioning. For example, in the case where the action of the crushing mill 10 causes over time a slackening of the belt 48, for example because of vibrations or other, the belt-tensing device 51 is re-adjusted so as to bring the belt 48 back to the correct level of tension.

The speed of the rotation shaft 31 of the distribution unit 27 is advantageously adjustable depending on the type, quantity and size of the material fed. The transmission ratio between the rotation shaft 31 and shaft 34 can also be varied as desired.

A plurality of hammers 33, in this case two, is disposed on the crushing rotor 47 of the crushing unit 32, able to throw the material arriving from the distribution unit 27 against a plurality of elements adjacent to each other so as to form a wall or shield 37, and provided with a profile suitably shaped to cause the material to break following its impact on the wall.

In this case too, there may be any number of hammers 33, for example comprised between 2 and 6, depending on the crushing/grinding needs required from the mill 10.

The shield 37 is disposed at an adequate distance from the crushing unit 32 and with its shaped profile facing toward the crushing unit 32, so as to allow the inert material thrown at it to be broken.

The box-like structure 40, which surrounds and supports the aforementioned components of the mill, comprises a lower box-like element 21 open at the upper part and an upper box-like unit 30 assembled on it.

The box-like unit 30 is at least partly movable with respect to the lower box-like element 21.

This partial mobility of the box-like unit 30 allows to define at least a partly open position of the box-like structure 40, able to simplify the maintenance operations of the crushing mill 10 when the machine is stopped, and a completely closed position when the mill 10 is working.

Depending on the possible forms of embodiment of the box-like structure 40, described below, different positions of semi-opening of the box-like structure 40 are possible, depending on the type of maintenance to be carried out inside the crushing mill 10.

The lower box-like element 21 is provided with reinforcement connection plates 22 to allow the box-like element 21 to adequately support the box-like unit 30, improving the stability of the entire box-like structure 40 when this is in a semi-open position.

Figure 1:
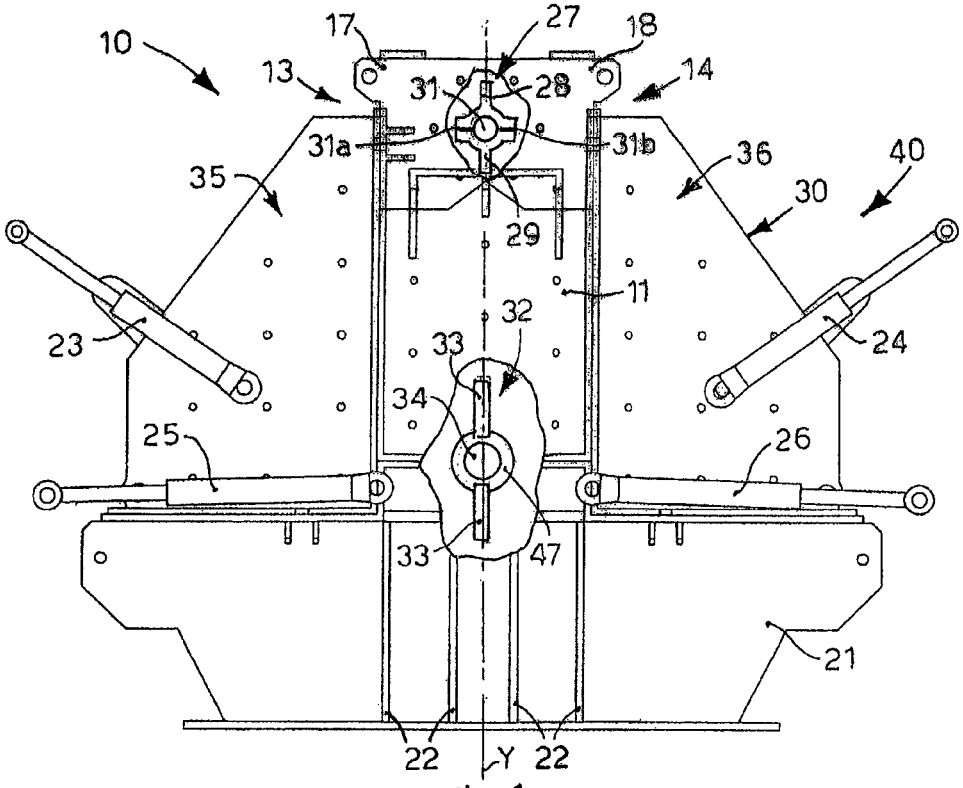
FIG. 1 is a partly sectioned front view of one form of embodiment of the crushing mill according to the present invention in a completely closed position.

The reinforcement connection plates 22 are disposed at least centrally with respect to the lower box-like element 21, as shown in FIGS. 1-2 and 4-8, advantageously along the whole lower box-like element 21, to allow a further stability of the entire box-like structure 40, as shown in FIG. 3.

The box-like unit 30 comprises two fixed walls 11 and 12, each symmetrical with respect to the axis Y, attached on the lower box-like block 21, respectively, at the front and at the rear of the box-like body 40.

The fixed wall 11 and the lower box-like block 21 have mating shaped attachment profiles, so as to define, once coupled, a hole 38 in order to allow the rotation shaft 34 to pass through the front wall of the box-like structure 40.

A hole 39, identical to the hole 38 and aligned with it, is made in the same way between the fixed wall 12 and the lower box-like block 21 to allow the rotation shaft 34 to pass through the rear wall of the box-like structure 40 too.

In this way the shaft 34 is supported by the box-like structure 40, passing through the two holes 38 and 39 of the box-like structure 40.

The fixed walls 11 and 12 are closed laterally and at the upper part with respect to each other by a first lateral casing 13 and a second lateral casing 14, identical to each other and disposed specular with respect to the axis Y.

When the box-like structure 40 is in a completely closed position, each lateral casing, 13 and 14, rests partly on the lateral and upper thicknesses of the fixed walls 11 and 12 and partly on the lower box-like element 21.

Each lateral casing 13 and 14 comprises a lower, lateral semi-shell, respectively 35 and 36, and an upper lateral semi-shell, smaller in size, respectively 17 and 18.

Each lower lateral semi-shell 35 and 36 comprises a movable support element, respectively 15 and 16, opposite each other and curved toward the inside of the box-like structure 40. Each movable support element 15 and 16 is able to support the elements that make up the shield 37, toward which the hammers 33 throw the material to be ground when the mill 10 is working. The grinding elements can be, depending on the case, shaped like a rectangular bar, a pointed triangle, a rounded head, or have a head to carry out the desired grinding effect depending on the material to be treated.

The two lower lateral semi-shells 35 and 36, when the box-like structure 40 is in a completely closed position, are adjacent to the lateral thicknesses of the two fixed walls 11 and 12 and define with them and with the lower box-like element 21*a* crushing chamber, in which the crushing unit 32 is housed and in which the crushing of the material coming from the feed device occurs.

The two upper lateral semi-shells, respectively 17 and 18, are fixed above the lower semi-shell 35 and the lower lateral semi-shell 36.

The two upper lateral semi-shells 17 and 18 are identical to each other, disposed specular with respect to the axis Y and positioned in a similar way on the respective lower lateral semi-shell, 35 and 36.

A semi-cylindrical housing, respectively 19 and 20, is assembled inside each upper lateral semi-shell 17 and 18.

In a completely closed position of the box-like structure 40, the two upper lateral semi-shells 17 and 18 are coupled along respective suitably shaped profiles and rest below on the fixed walls 11 and 12, allowing the complete closing of the box-like structure 40.

The mating shaped profiles of the two upper lateral semi-shells 17 and 18 define, in a completely closed position of the box-like structure 40, suitable holes 37 for the assembly of the distribution unit 27.

The coupling of the two upper lateral semi-shells 17 and 18 entails the coupling of the two respective semi-cylindrical housing seatings 19 and 20, to define a distribution chamber inside which the distribution unit 27 is housed.

With reference to the FIGS. 1, 2, 3 and 6, the first lateral containment casing 13 and the second lateral containment casing 14 are translatable along the upper end of the lower box-like element 21 with opposite directions of movement.

The opposite directions of movement, if facing toward the outside of the box-like structure, 40 cause a distancing of the lateral containment casings 13 and 14 from the fixed walls 11 and 12 and allow to pass from a position of the lateral containment casings 13 and 14 adjacent to the fixed walls 11 and 12, shown in FIGS. 1 and 6, to a distanced position of the lateral containment casings 13 and 14 from the fixed walls 11 and 12, shown in FIG. 2, which leaves the distribution unit 27 completely uncovered.

Indeed, the upper lateral semi-shells 17 and 18 are solid with the lower lateral semi-shells on which they are attached, respectively 35 and 36, and translate with them.

The direct accessibility to the distribution unit 27 allows it to be maintained easily and safely, so that for example it is easy to selectively replace the blades 28 and 29.

The translation of the lateral casings 13 and 14 occurs by means of two linear actuators, respectively 25 and 26, disposed perpendicularly to the axis Y, in the direction of translation and attached with one of their ends to the lower box-like element 21 and with the other end to the lateral casing to be moved, respectively 13 and 14.

In this form of embodiment, the length of the upper end of the lower box-like element 21 in the direction of movement is directly correlated to the distance that the lateral casings 13 and 14 can assume in the distanced position.

To allow a safe and smooth movement of the lateral containment casings 13 and 14, along the upper end of the lower box-like element 21 there are two guides, in this case of a trapezoidal shape, one for each of the lateral containment casings 13 and 14.

According to another form of embodiment shown in FIGS. 4, 5, 7 and 8, each lateral casing 13 and 14 is hinged to the lower box-like element 21 by means of a hinging element, respectively 44 and 45, and can be selectively rotated with respect to the hinging element 44 and 45 by means of a linear actuator, respectively 41 and 42, assembled transversely on the box-like structure 40, hinged with one end to the lower box-like element 21 and with the other end to the lateral containment casing to be moved, respectively 13 and 14.

FIGS. 4, 5, 7 and 8 show the box-like structure 40 with both the lateral casings 13 and 14 rotated toward the outside of the box-like structure 40, in order to leave the distribution unit 27 completely uncovered.

With reference to the attached drawings, the first movable support element 15 and the second movable support element 16 are hinged on one side of the lower lateral semi-shell, respectively 35 and 36, by means of a hinging element and can be selectively rotated with respect to the hinging element by means of linear actuators, respectively 23 and 24, assembled transversely on the box-like structure 40.

Each linear actuator 23 and 24 is hinged by one end to the lower lateral semi-shell, respectively 35 and 36, and by the other end, respectively, to the first movable support element 15 and to the second movable support element 16 to be moved.

The first movable support element 15 and the second movable support element 16 rotate in opposite directions.

If the rotation occurs toward the outside of the box-like structure 40, the movable support elements 15 and 16 move from the closed position to an open position jutting out toward the outside, functional to the maintenance operations of the elements of the shield 37 or other.

According to another form of embodiment shown in FIG. 6, each lateral casing 13 and 14 comprises a frame 46 to which a plurality of doors 43 are hinged, which in a closed position are attached to the frame and return the lateral casing into the configuration shown in FIGS. 1-5 and 7-8.

Each door 43 can be selectively opened in order to make it easier for the operators during maintenance to access the portions of crushing chamber closed by the lateral casings 13 and 14.

Figure 7:
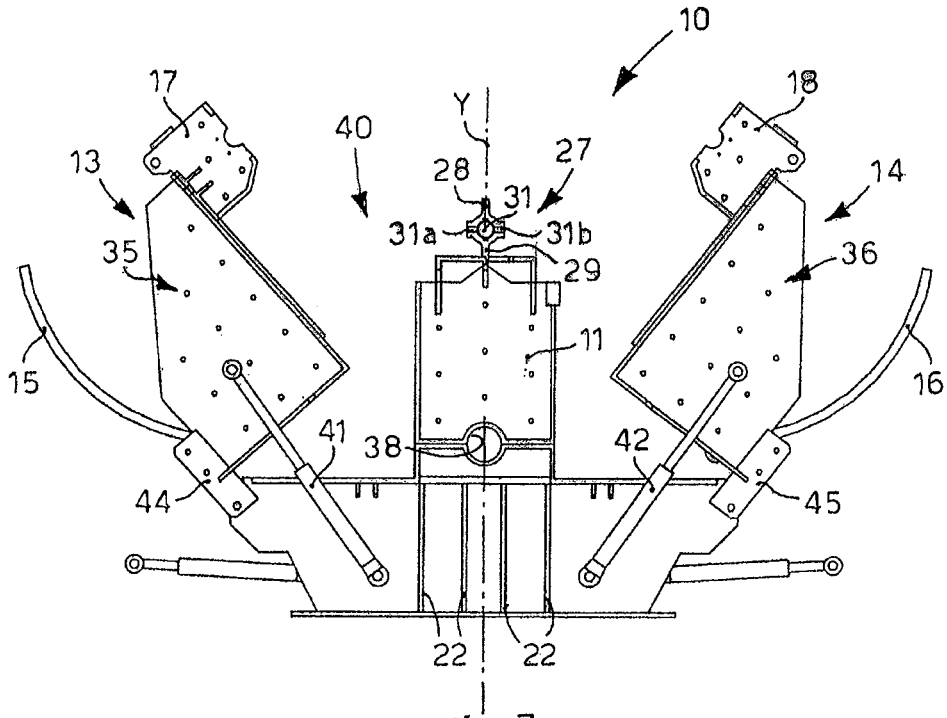
FIG. 7 is a front view of a form of embodiment of the crushing mill in a completely open position with the distribution rotor in a first operating position.
Figure 8:
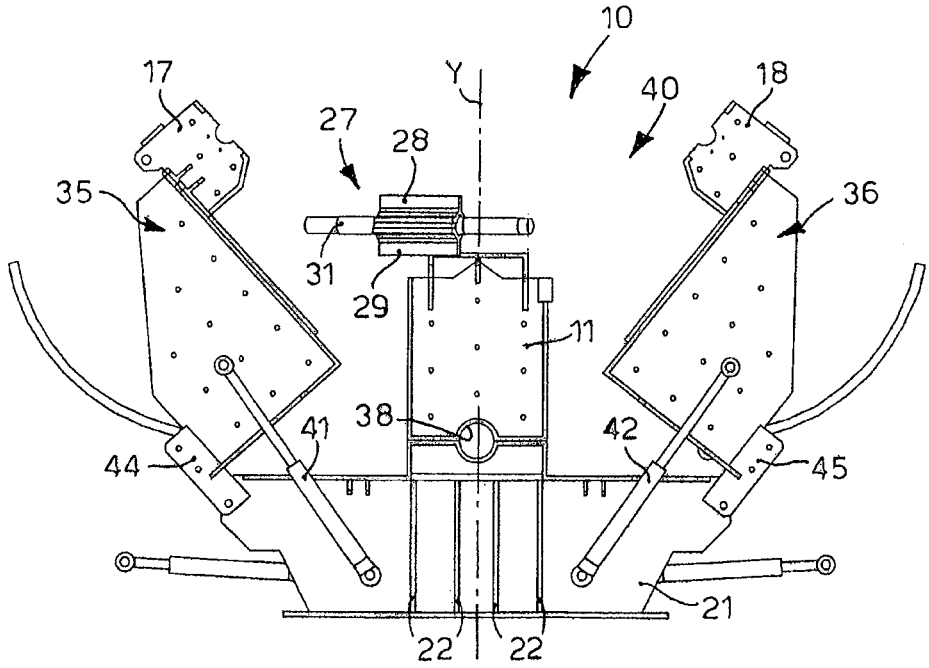
FIG. 8 is a front view of a form of embodiment of the crushing mill in FIG. 7 in a completely open position with the distribution rotor in a second operating position.

FIGS. 7 and 8 show a variant of the distribution unit 27.

The distribution unit 27 can be rotated on a plane perpendicular to the axis Y, when the lateral casings 13 and 14 are in an open position.

Indeed the opening of the lateral casings 13 and 14 prevents the distribution unit 27 from knocking against them during its rotation.

The rotation of the distribution unit 27 allows to pass from an operating position of the distribution unit 27 as shown in FIG. 7, in which the rotation shaft 31 is parallel to the rotation shaft 34 of the crushing rotor 32, to a position where the machine is not working, as shown in FIG. 8, in which the rotation shaft 31 is perpendicular to the rotation shaft 34 of the crushing rotor 32, in order to reduce the bulk of the distribution unit 27, or vice versa.

It is clear that modifications and/or additions of parts may be made to the crushing mill 10 as described heretofore, without departing from the field and scope of the present invention.

It is also clear that, although the present invention has been described with reference to some specific examples, a person of skill in the art shall certainly be able to achieve many other equivalent forms of crushing mill, having the characteristics as set forth in the claims and hence all coming within the field of protection defined thereby.

The invention claimed is:

1. A crushing mill to crush inert material comprising a distribution unit, a crushing unit disposed below said distribution unit and a containment structure able to contain said distribution unit and said crushing unit, said distribution unit receiving the inert material from a feed device and suitably directing it toward the crushing unit below, for the secondary and/or tertiary crushing of the inert material, wherein said containment structure has at least two lower lateral semi-shells, associated with the crushing unit, and at least two upper lateral semi-shells, associated with the distribution unit, which are selectively movable, independently or together, so as to obtain an at least partly open configuration of the mill, which leaves at least the distribution unit completely uncovered and easily accessible, and advantageously also the crushing unit.

2. The crushing mill as in claim 1, wherein the distribution unit and the crushing unit each have a rotation axis and wherein the movement of the upper and/or the lower lateral semi-shells occurs by means of rotation around a fulcrum lying on a plane disposed below at least the axis of rotation of the distribution unit, and advantageously also below the axis of rotation of the crushing unit.

3. The crushing mill as in claim 1, wherein the movement of the upper and/or the lower lateral semi-shells occurs by means of translation on a plane substantially parallel to a resting plane of the crushing mill.

4. The crushing mill as in claim 1, wherein the containment structure comprises a lower containment element and two fixed walls substantially parallel with respect to each other, one assembled at the front and the other at the rear on the lower containment element and interposed between said lower and upper lateral semi-shells, said lower and upper lateral semi-shells being movable with respect to the lower containment element so as to selectively define at least an access opening on the containment structure.

5. The crushing mill as in claim 1, wherein each lower lateral semi-shell comprises a movable support element curved toward the inside of the containment structure and able to house a wall with a shaped profile able to cooperate with the crushing unit for an efficient crushing of the inert material, said movable support element being hinged on the lower part of the respective lower lateral semi-shell by means of a hinging element and selectively rotatable with respect to said hinging element.

6. The crushing mill as in claim 1, wherein the upper and lower lateral semi-shells are provided at the front and rear with a plurality of doors selectively openable to facilitate access to the inside of said containment structure.

7. The crushing mill as in claim 1, wherein the distribution unit comprises a rotation shaft and a plurality of fins on which blade means are attached, said fins and said rotation shaft being made starting from a profile with a section chosen from between circular or polygonal, suitably subjected to mechanical working.

8. The crushing mill as in claim 1, wherein the distribution unit is rotatable around a fulcrum on a plane parallel to the ground between an operating position and a non-working position.

9. The crushing mill as in claim 4, wherein, distributed along its surface, said lower containment element has a plurality of reinforcement connection plates to improve the stability of the containment structure in a condition of at least partial opening.

10. The crushing mill as in claim 7, wherein the crushing unit comprises a rotation shaft, wherein the crushing mill comprises a transmission belt for the transmission of the motion between the rotation shafts, with which a belt-tensing device is associated, able to maintain the transmission belt at a desired working tension.

* * * * *